US010800494B2

(12) United States Patent
Deal

(10) Patent No.: US 10,800,494 B2
(45) Date of Patent: Oct. 13, 2020

(54) WINDSHIELD FOR A CENTER CONSOLE BOAT

(71) Applicant: MAVERICK BOAT GROUP, INC., Fort Pierce, FL (US)

(72) Inventor: Douglas Scott Deal, Vero Beach, FL (US)

(73) Assignee: MAVERICK BOAT GROUP, INC., Fort Pierce, FL (US)

( * ) Notice: Subject to any disclaimer, the term of this patent is extended or adjusted under 35 U.S.C. 154(b) by 58 days.

(21) Appl. No.: 16/250,766

(22) Filed: Jan. 17, 2019

(65) Prior Publication Data

US 2019/0233057 A1 Aug. 1, 2019

Related U.S. Application Data

(60) Provisional application No. 62/625,100, filed on Feb. 1, 2018.

(51) Int. Cl.

| | |
|---|---|
| ***B63B 19/02*** | (2006.01) |
| ***B63B 15/00*** | (2006.01) |
| ***B63B 17/00*** | (2006.01) |

(52) U.S. Cl.

CPC ..... *B63B 19/02* (2013.01); *B63B 15/00* (2013.01); *B63B 17/00* (2013.01); *B63B 2017/0045* (2013.01)

(58) Field of Classification Search

CPC ..... B63B 19/02; B63B 17/00; B63B 15/00
See application file for complete search history.

(56) References Cited

U.S. PATENT DOCUMENTS

| | | | | |
|---|---|---|---|---|
| 3,783,461 | A * | 1/1974 | Sugden | B63B 19/02 114/361 |
| 3,810,267 | A * | 5/1974 | Fussell, Jr. | B63B 19/02 114/361 |
| 4,473,026 | A * | 9/1984 | Bass | B63B 17/04 114/255 |
| 5,309,860 | A * | 5/1994 | Shearer | E05D 5/10 114/361 |
| 5,784,982 | A * | 7/1998 | Erskine | B60J 1/06 114/361 |
| 6,149,228 | A * | 11/2000 | O'Neill | B60R 21/131 296/190.01 |
| 6,647,914 | B1 * | 11/2003 | Gerhardinger | B63B 19/02 114/361 |

(Continued)

*Primary Examiner* — Lars A Olson
*Assistant Examiner* — Jovon E Hayes
(74) *Attorney, Agent, or Firm* — Buchanan Ingersoll & Rooney PC

(57) ABSTRACT

An exemplary windshield assembly for a marine vessel includes a plurality of first extrusions arranged vertically; a plurality of second extrusions, wherein each second extrusion is a crossbar arranged between a pair of first extrusions; and an opening formed between each pair of second extrusions connected between a common pair of first extrusions, wherein each opening includes a plurality of receivers formed for framing a panel, the plurality of receivers formed on a surface of each first extrusion and each second extrusion of a respective opening, and wherein a front opening includes an upper second extrusion and movable front panel, the movable front panel being connected to rotate about the upper second extrusion for venting.

20 Claims, 4 Drawing Sheets

(56) References Cited

U.S. PATENT DOCUMENTS

| | | | | |
|---|---|---|---|---|
| 6,837,173 | B2 * | 1/2005 | Eck | B63B 3/48 114/361 |
| 7,032,533 | B2 * | 4/2006 | Weind | B60J 1/002 114/177 |
| 10,246,164 | B1 * | 4/2019 | Flota | B60J 1/16 |
| 10,569,855 | B2 * | 2/2020 | Chaumel | B64C 1/1476 |
| 2007/0051295 | A1 * | 3/2007 | Gonzales | B63B 17/02 114/361 |
| 2007/0193495 | A1 * | 8/2007 | Debasto | B63B 17/02 114/361 |
| 2018/0072386 | A1 * | 3/2018 | Dube | B63B 71/00 |
| 2019/0092437 | A1 * | 3/2019 | Coletti | B63B 45/08 |
| 2019/0233057 | A1 * | 8/2019 | Deal | B63B 17/00 |

* cited by examiner

SECTION "B-B"

WINDSHIELD FOR A CENTER CONSOLE BOAT

FIELD

The present disclosure relates to a windshield or windshield assembly for a center console boat.

BACKGROUND

Center console windshields are generally mounted to welded tabs or receivers on the outside of a tubular aluminum frame mounted to the outside of a center console or in a forward-facing receiver in an extrusion that is also mounted to the outside of a center console. Such installations require a lot of glazing and often a paint line, typically black, to cover up the glazing that is visible and unattractive absent this cosmetic cover up. They are not typically integrated into the console design itself, and appear as afterthought installations. Vents in these installations are either absent or typically open forward and are incased by a fixed frame which is unattractive and which breaks up the sight lines of the forward glass or acrylic panel, impairing the vision of the operator of the vessel. Forward opening vents do not allow the end user to control both the volume and direction of air that the applicant's air ram/venting device does provide. In addition, typical center console windshield installations do not allow for after the fact installation of a windshield in the field by dealers or retail consumers.

SUMMARY

An exemplary windshield assembly for a marine vessel is disclosed, comprising: a plurality of first extrusions arranged vertically; a plurality of second extrusions, wherein each second extrusion is a crossbar arranged between a pair of first extrusions; and an opening formed between each pair of second extrusions connected between a common pair of first extrusions, wherein each opening includes a plurality of receivers formed for framing a panel, the plurality of receivers formed on a surface of each first extrusion and each second extrusion of a respective opening, and wherein a front opening includes an upper second extrusion and movable front panel, the movable front panel being connected to rotate about the upper second extrusion for venting.

An exemplary windshield enclosure for a center console boat is disclosed, comprising: a frame including a plurality of first members and a plurality of second members, each of the first members and second members having extruded profiles forming receiver planes, each second member being arranged horizontally between a pair of vertical first members; a plurality of apertures formed in the frame wherein upper and lower second members are arranged between a common pair of vertical first members; and at least one panel arranged in each aperture, each at least one panel being framed by a receiver plane of respective first and second members bordering the aperture, wherein a front aperture of the plurality of apertures includes a movable upper panel and a fixed lower panel, a lower edge of the movable upper panel is rotatable to an open and closed position with respect to a seal connected to an upper edge of the fixed lower panel.

BRIEF DESCRIPTION OF THE DRAWINGS

The scope of the present disclosure is best understood from the following detailed description of exemplary embodiments when read in conjunction with the accompanying drawings, wherein.

DETAILED DESCRIPTION

Figure 1:
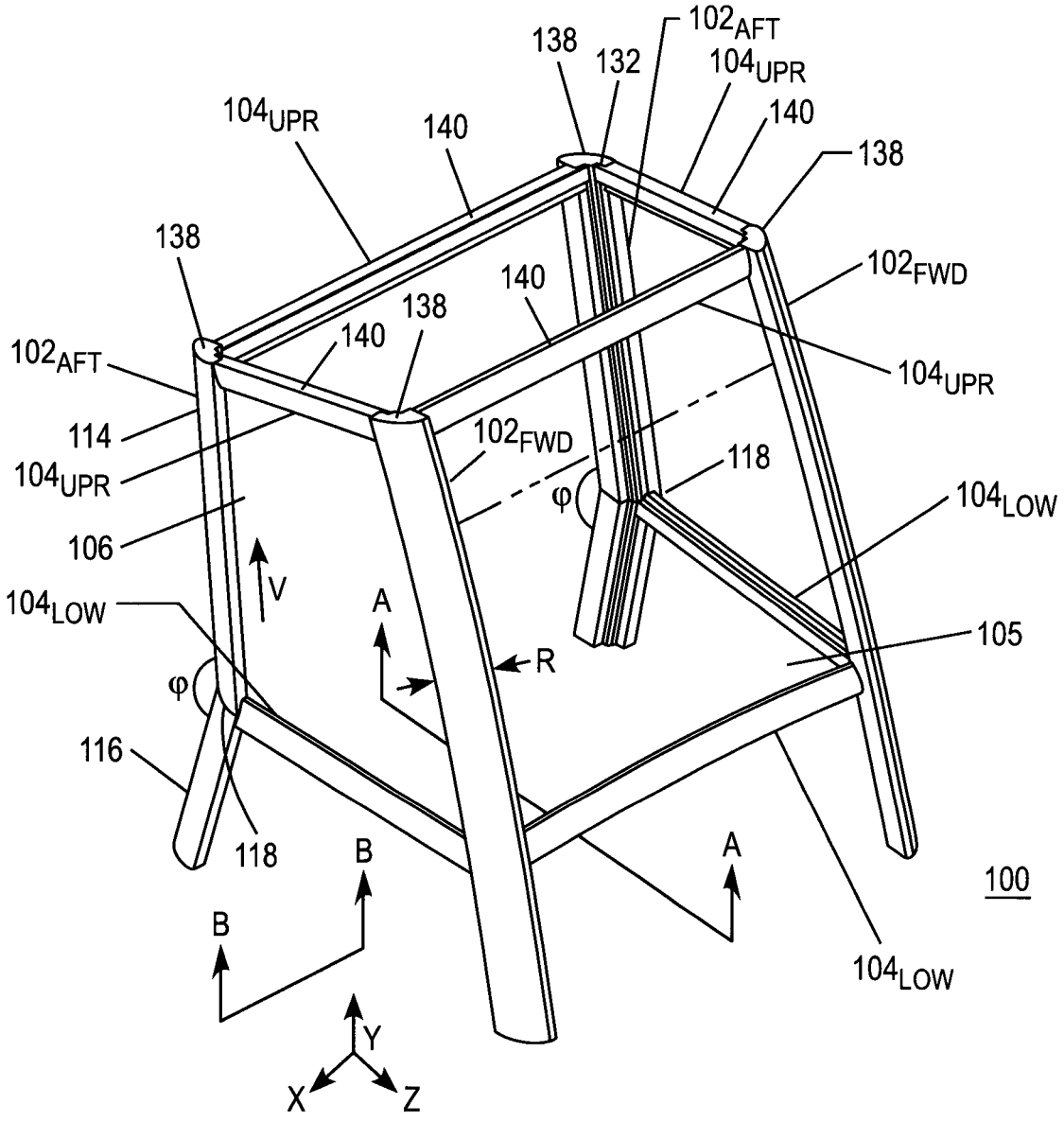
FIG. 1 illustrates an isometric view of a windshield assembly in accordance with an exemplary embodiment of the present disclosure.

The present disclosure relates to a windshield assembly for a center console. The windshield assembly formed of an extruded aluminum frame and having a frameless vent integrated into the front or forward panel. The vent acts as an adjustable air ram. The extruded aluminum frame is specifically designed with a receiver for mounting either tempered glass or acrylic panels on the forward and both port and starboard sides. The panels attach by means of very high bond (VHB) tape, glue, or other suitable adhesive and are installed on the inside of the frame, attaching to the receivers. The present design allows for a completely seamless, glazeless and paintless installation that is much more aesthetically pleasing and which can be added as an add-on or aftermarket item to a boat in the field that was initially ordered without the windshield. This allows wholesalers to order stock inventory without committing to the expense of the windshield assembly and to simply and easily add the entire panel assembly to the here to fore open extruded and welded frame of a marine vessel should a retail buyer prefer a console with the 3-panel windshield and air ram/vent assembly installed on a stock boat a retailer has on their showroom floor.

An exemplary embodiment of the center console windshield of the present disclosure offers improved styling, cosmetic appearance, and functionality over existing designs. Additional benefits include a much simpler installation process due to the inward facing receivers provided by the two extrusions. These receivers allow for the use of very simple VHB tape to hold the acrylic or tempered glass panels (or panels made of any other suitable material) in place and eliminate the need for glazing or mechanical tabs to hold the panels in place as in existing designs, both of which are unattractive and very time consuming to install. The effect is a dramatic improvement in the cosmetic appearance and the installation time. The cosmetic improvement is further enhanced by the external radius design of the two extrusions which install inside a recess in the fiberglass console that was tooled specifically to match these radii. Once installed, the extrusions blend into the vessel console making the combination of the extruded frame and the console appear as one integrated design. Also, the opening vent design of the windshield assembly allows an end user to have increased control of both the volume and direction of air.

A first extrusion of the windshield assembly has two separate distinct receivers for the side panels and the forward panel integrated into a single extrusion. Additional benefits of this design include overall ease of installation, the ability to offer after the fact (e.g., aftermarket) installation, and the aforementioned cosmetic improvements. A mechanically, electrically, or manually actuated vent that also acts as an adjustable air ram making the vessel more comfortable and pleasant for passengers during operation.

Another benefit of the design of the first extrusion 1 is the asymmetrical internal bulkhead structure which provides both improved robustness but also an oversized internal chase tube that offers the ability to run bulky connections such as terminal plugs for hard top mounted radar installations and other electrical components inside the extrusion where they are protected from harsh marine elements and hidden from view.

An exemplary embodiment of the present disclosure is directed to a windshield enclosure for a center console boat formed of an extruded aluminum frame consisting of two individual extruded profiles which are welded together to form a frame and which is bounded by tempered glass or acrylic panels on the forward, port, and starboard sides and by a top which rests on the upper surface of the upper frame. The top can be formed of of fiberglass and most commonly referred to as a hard top. The top can be a single piece hard top or can have removable panels separated by a central rib in a T-top construction. Forward, port, and starboard side panels attach to the inside receivers of the first extrusions by means of VHB tape. Above a stationary forward panel is a frameless and inward-opening air ram/vent that allows the user to control the volume and direction of air flow as desired and which is adjusted by means of a mechanical actuator which, when fully extended closes the vent and seals against the extruded flange and a seal attached upper edge of the forward fixed panel. The upper section of the vent panel attaches to the upper extrusion by means of mechanical fasteners and hinges.

Exemplary embodiments of the present disclosure integrate a windshield frame into the T-Top/Hard Top frame as well as the console itself, forming one integrated design that looks and performs far superior to other designs on the market. This design incorporates an extruded aluminum frame with flanges that allow for installation of the acrylic panels on the inside of the frame eliminating the need for messy caulk lines to hide the seam which are required when glass or acrylic panels are mounted from the outside of the frame. The venting window opens inward and is adjustable so the operator can control both the volume and direction of air passing through the vent when open. The vent closes against the flanges of the extruded frame on the inside as well, eliminating the need for a separate frame for the vent window. This design will work with acrylic panels which are far cheaper and easier to work with than tempered glass. This design does not require a lot of unattractive cosmetic caulking to hide joints between the panels and the frame. This design can be added to a boat built with the extrusion and console but ordered without the windscreen or windshield option after the fact. By having the vent open inward, the air flow can be directed at the operator and passengers precisely if desired on a hot day. The present disclosure describes the windshield design being applied to a center console; however, the windshield design can be applied to other types of consoles (e.g., side console, etc.) or other areas of a boat. The extrusions can be made of aluminum, or of any suitable material, such as steel, iron, titanium, carbon fiber, graphite, fiberglass, a metal alloy, etc., as desired.

FIG. 1 illustrates an isometric view of a windshield assembly in accordance with an exemplary embodiment of the present disclosure. As shown in FIG. 1, the windshield assembly 100 can include a plurality of first extrusions 102 arranged to be substantially parallel with a vertical axis (y) of the assembly, a plurality of second extrusions 104 arranged as a crossbar between pairs of first extrusions. An opening 106 is formed in a vertical direction (y) between each pair of second extrusions 104. Each first and second extrusion 102, 104 in the opening having receivers formed on a surface that faces an interior of the windshield assembly 100. A front or forward opening 106 has a movable front panel that is connected to rotate about an upper second extrusion 104 for venting.

The first extrusions 102 function as legs for the windshield assembly 100. As such, the windshield assembly 100 can include four first extrusions 102 of substantially the same length. One pair of first extrusions $\mathbf{102}_{FWD}$ can serve as forward legs and another pair of first extrusions $\mathbf{102}_{AFT}$ can serve as aft legs. One or more second extrusions 104 are connected between adjacent first extrusions 102 on the, port, starboard, forward and aft sides of the windshield assembly 100. The second extrusions 104 connecting the adjacent first extrusions 102 can include an upper second extrusion $\mathbf{104}_{UPR}$ and a lower second extrusion $\mathbf{104}_{LOW}$. A lower second extrusion $\mathbf{104}_{LOW}$ can be included on the port, starboard and forward sides of the windshield assembly 100. According to an exemplary embodiment, for at least each starboard and port opening 106 of the windshield assembly 100, the lower second extrusion $\mathbf{104}_{LOW}$ is greater in length than the upper second extrusion $\mathbf{104}_{UPR}$. As a result, a bottom footprint of the windshield assembly 100 has a greater surface area than a top footprint of the windshield assembly 100. This arrangement provides a stable base and also allows the frame of the windshield assembly 100 to fit within the recess of the boat or vessel console.

The first extrusions $\mathbf{102}_{FWD}$ serving as forward legs can have a substantially straight profile along an entire length. According to an exemplary embodiment, the forward legs $\mathbf{102}_{FWD}$ can be arranged at an angle $\alpha$ with respect to the vertical axis (y) of the windshield assembly 100. According to another exemplary embodiment, the forward legs $\mathbf{102}_{FWD}$ can be formed in an arc with a radius R in the range of 0.5" to 5". Both the angle $\alpha$ and the radius R are directly proportional to the difference in length between the upper second extrusion $\mathbf{104}_{UPR}$ and the lower second extrusion $\mathbf{104}_{LOW}$.

The first extrusions $\mathbf{102}_{AFT}$ serving as aft legs can include an integrated upper portion 114 and lower portion 116. The upper portion 114 can have a substantially straight profile. The lower portion 116 is integrated with the upper portion 114 on a lower end and extends at an angle $\varphi$ offset from the axis (V) of the upper portion 114. The lower second extrusion $\mathbf{104}_{LOW}$ of the port and starboard sides of the windshield assembly 100 connect to the corresponding aft leg $\mathbf{102}_{AFT}$ at the connecting or integration point 118 of the upper portion 114 and lower portion 116 of the corresponding aft leg $\mathbf{102}_{AFT}$. The upper portion 114 and lower portion 116 of the first extrusion 102 can be formed from a single piece or mold, or can be formed of two separate pieces attached to each other via a weld, bracket, plate, or other suitable attachment means as desired.

Figure 2:
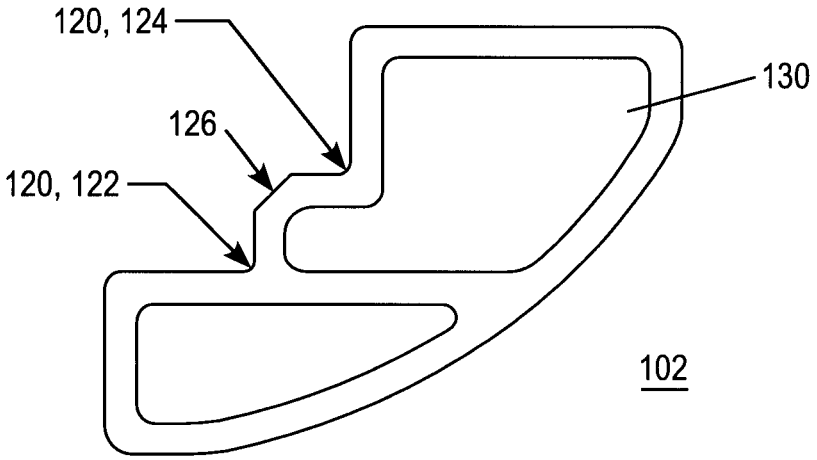
FIG. 2 illustrates a top view of a first extrusion of the windshield assembly in accordance with an exemplary embodiment of the present disclosure.

FIG. 2 illustrates a top view of a first extrusion of the windshield assembly in accordance with an exemplary embodiment of the present disclosure. As shown in FIG. 2, the first extrusion 102 has an asymmetric shape, which establishes several structural features. For example, the inward facing side of the first extrusion includes plural surfaces 120 (i.e., receivers, flanges) for receiving a windscreen or window panel 121 and alternately providing a mating surface of a second extrusion. The plural surfaces 120 can include a forward panel receiver 122 and a port or starboard panel receiver 124. The forward and port or starboard panel receivers 122, 124 are separated by a lip 126. The forward panel receivers 122 are configured to mate to receiver surfaces 120 of the upper second extrusion $\mathbf{104}_{UPR}$ and lower second extrusion $\mathbf{104}_{LOW}$. The first extrusion 102 also includes an asymmetrical internal bulkhead structure 128 which provides both improved strength and serves an internal chase tube 130. The internal chase tube 130 can provide a channel for running bulky connections such as terminal plugs for electrical components mounted to the windshield assembly 100. For example, the internal chase tube 130 can provide a conduit for wiring associated with a radar device or other marine or communication components attached on or near the windshield assembly 100 such that the wiring and/or electronic connections can be protected from harsh marine elements and hidden from view.

Figure 3:
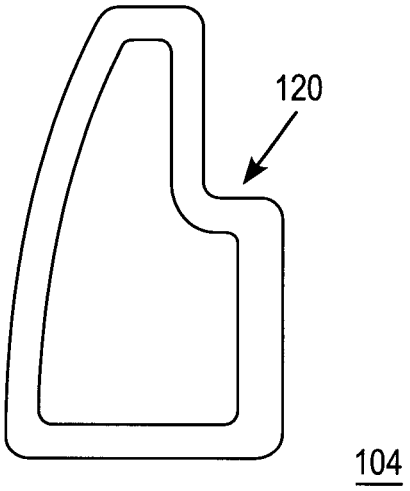
FIG. 3 illustrates a side view of a second extrusion in accordance with an exemplary embodiment of the present disclosure.

FIG. 3 illustrates a side view of a second extrusion in accordance with an exemplary embodiment of the present disclosure. As shown in FIGS. 1 and 3, the second extrusion 104 includes a panel receiver surface 120 for receiving a port, starboard or forward window panel 121 of the windshield assembly 100. The panel receiver 120 extends along a length of the second extrusion 104 and faces an interior of the windshield assembly 100. The second extrusion 104 also includes a notched edge 132 (see FIG. 1) on each end for mating with a receiver surface 120 of the forward and aft first extrusions $\mathbf{102}_{FWD}$, $\mathbf{102}_{AFT}$.

Figure 4:
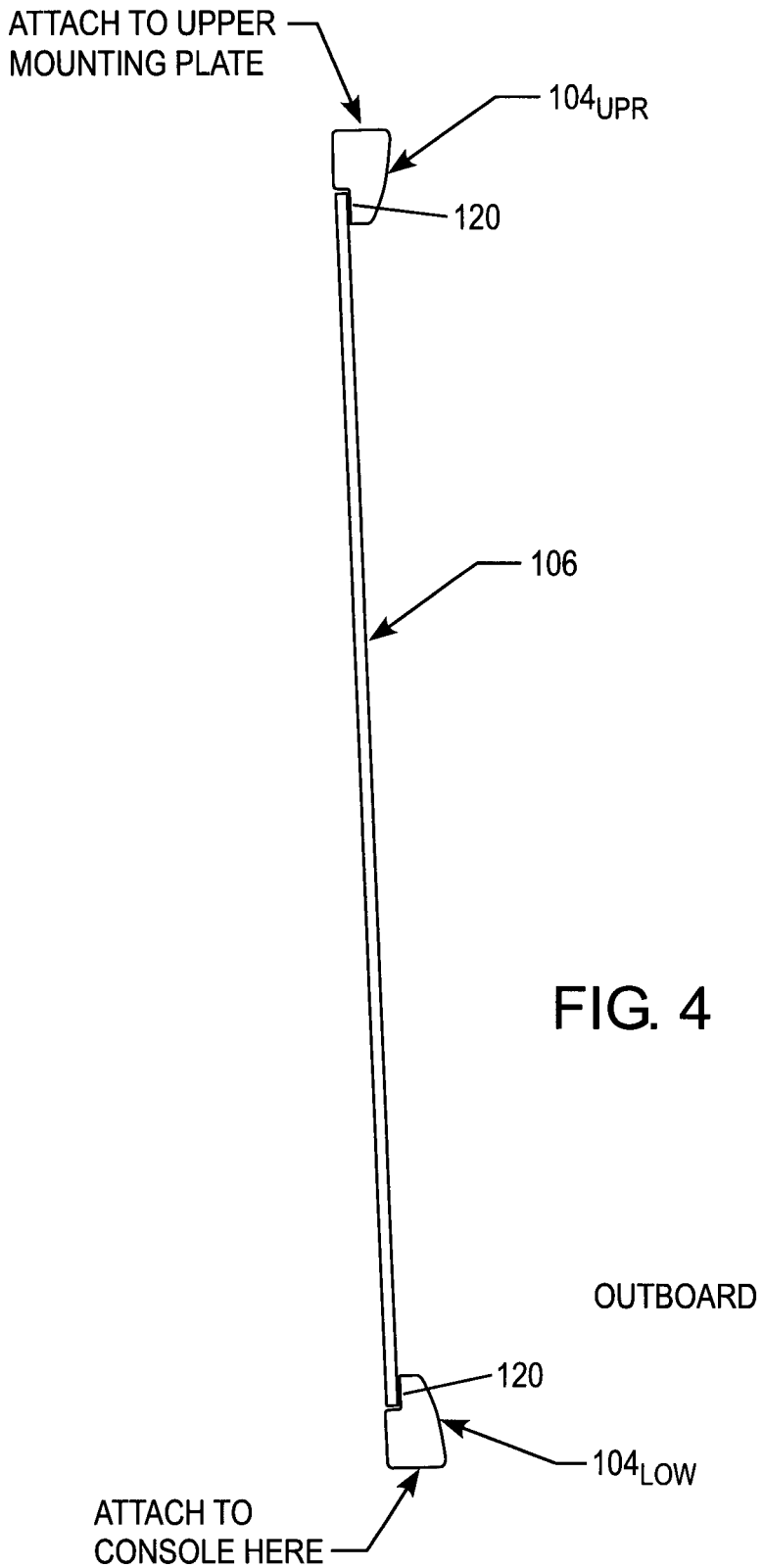
FIG. 4 illustrates a section B-B of the windshield assembly of FIG. 1 that includes panels attached to the second extrusions in accordance with an exemplary embodiment of the present disclosure.

FIG. 4 illustrates a section B-B of the windshield assembly of FIG. 1 that includes panels attached to the second extrusions in accordance with an exemplary embodiment of the present disclosure. As shown in FIGS. 1 and 4, a panel 121 is mounted to the receiver surfaces 120 of the upper and lower second extrusions $\mathbf{104}_{UPR}$, $\mathbf{104}_{LOW}$. The panel 121 can be secured to the receiver surfaces 120 via very high bond (VHB) adhesive, glue, tape or any other suitable material for attaching the panel to the receiver surface 120. Each panel 121 can be formed of tempered glass or acrylic or any other suitable transparent or semi-transparent material suitable to function as a windshield or windscreen.

Figure 5:
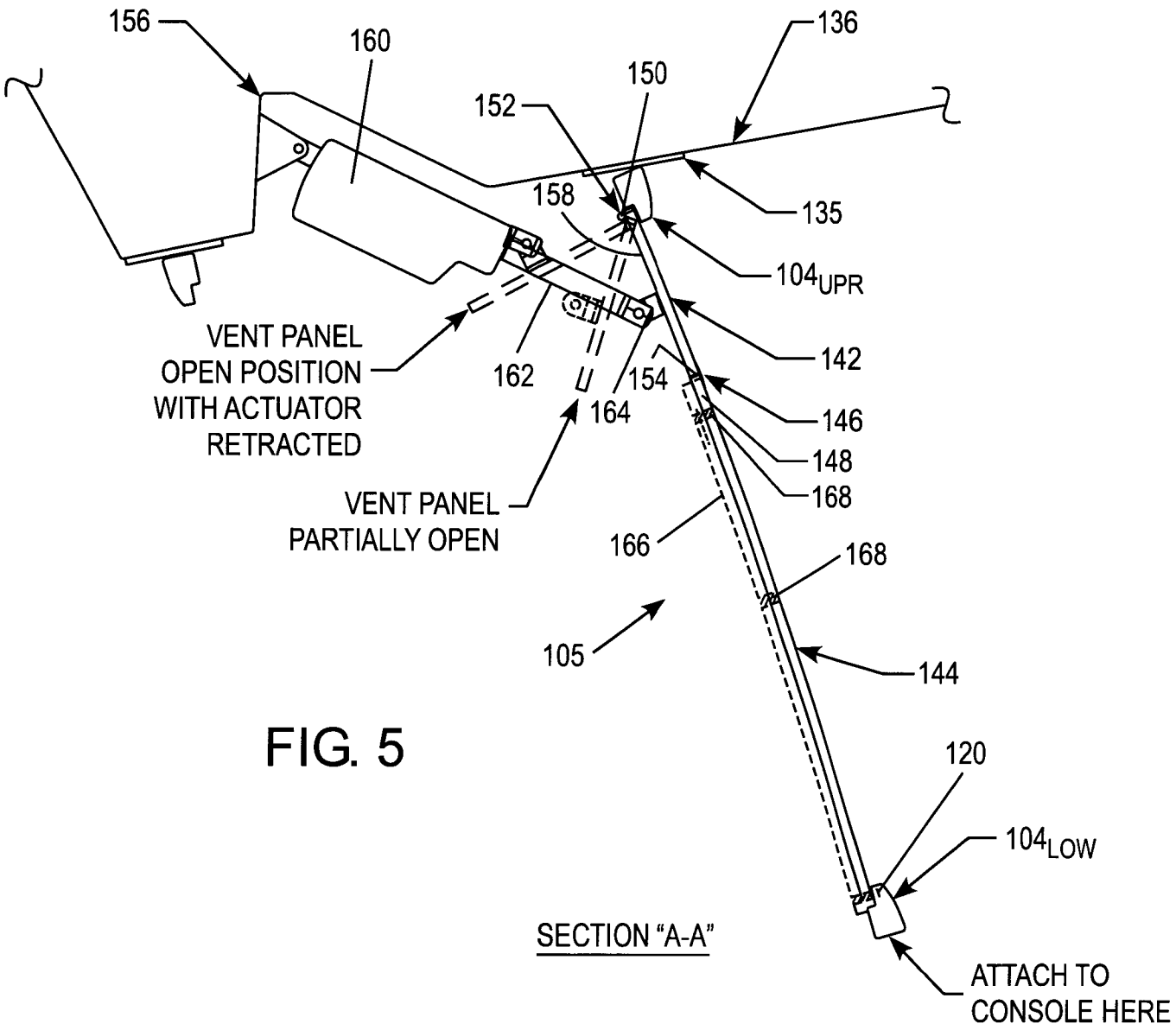
FIG. 5 illustrates a section A-A of the windshield assembly of FIG. 1 including a front panel having an actuated vent panel in accordance with an exemplary embodiment of the present disclosure.

FIG. 5 illustrates a section A-A of the windshield assembly of FIG. 1 including a forward panel having an actuated vent panel in accordance with an exemplary embodiment of the present disclosure. As shown in FIGS. 1 and 5, the windshield assembly 100 includes a forward panel 134 that is mounted in a forward opening 105 bordered by an upper forward second extrusion $\mathbf{104}_{UPR}$ and a lower forward second extrusion $\mathbf{104}_{LOW}$. The upper forward second extrusion $\mathbf{104}_{UPR}$ is mounted or attached to a top panel 136 of the windshield assembly 100 via a mounting plate 135. The top panel 136 can be mounted, attached or secured to the upper end surfaces 138 (FIG. 1) of the first extrusions 102 and the upper surfaces 140 (FIG. 1) of the upper forward, port, and starboard second extrusions 104. The forward panel 134 can include a moveable upper panel 142 and a fixed lower panel 144 mounted to the receiver surfaces 120 of the first and second extrusions $\mathbf{104}_{UPR}$, $\mathbf{104}_{LOW}$. According to an exemplary embodiment the fixed lower panel 144 can have a greater height in the vertical axis (y) direction of the windshield assembly 100 than the moveable upper panel 142. A seal 146 is attached to an upper edge 148 of the fixed lower panel 144 to prevent air, particles, or fluids from passing between the fixed lower panel 144 and the movable upper panel 142. The seal 146 can be formed of EPDM (ethylene propylene diene monomer) rubber, a thermoplastic elastomer (TPE) mix of plastic and rubber, a thermoplastic olefin (TPO) polymer/filler blend, silicone, or any other suitable material as desired. An upper edge 150 of the movable upper panel 142 is mounted to the forward upper second extrusion $\mathbf{104}_{UPR}$ via a hinge 152 and a lower edge 154 of the movable upper panel 142 is movable with respect to the seal 146 attached to the upper edge 148 of the fixed lower panel 144.

An actuator assembly 156 is attached to an inner surface 158 of the top panel 136. The actuator assembly 156 includes an actuator body 160 that contains the driving components (not shown) and an arm 162 having a distal end 164 mounted to the inner surface 158 of the movable upper panel 142. The actuator assembly 156 can drive the arm 162 such that the movable upper panel 142 moves between an open position and a closed position with respect to contact with a surface of the seal 146. During an opening operation, the arm 162 retracts into the actuator body 160 and rotates the movable upper panel 142 about the hinge 152 in an inward direction away from the seal 146. During a closing operation, the arm 162 is driven to extend out of the actuator body 160 and rotates the movable upper panel 142 about the hinge 152 in a direction toward the seal 146. The movable upper panel 142 is rotatable from the closed position up to an angle of 90° in the fully open position. The actuator assembly 156 can be controlled to rotate the movable upper panel 142 to any partially open position between the fully open and fully closed positions as desired. As a result, the amount of air flow directed at the operator and passengers can be controlled.

According to an exemplary embodiment, the fixed lower panel 144 can be mounted to the receiver surfaces 120 of the first extrusions 102 and the lower forward second extrusion $\mathbf{104}_{LOW}$ using battens 166. The battens 166 are formed using the same material (e.g., aluminum) as that of the first and second extrusions. The battens 166 can be attached to the receiver surfaces 120 of the forward first extrusions 102 and the lower forward second extrusion $\mathbf{104}_{LOW}$ via one or more rivets 168 or any other suitable attachment material or mechanism as desired. When mounted, the fixed lower panel 144 is arranged between the batten 166 and the corresponding first extrusion 102 and lower forward second extrusion $\mathbf{104}_{LOW}$, where applicable. The rivets 168 pass through mounting holes (not shown) formed in the batten 166, the fixed lower panel 144, and the receiver surfaces 120. The battens 166 can be used as an alternative to or in combination with other attachment or securing means (e.g., very high bond (VHB) adhesive, glue, tape or any other suitable material) for the forward lower panel 144 as disclosed herein.

Thus, it will be appreciated by those skilled in the art that the disclosed windshield for a center console can be embodied in other specific forms without departing from the spirit or essential characteristics thereof. The presently disclosed embodiments are therefore considered in all respects to be illustrative and not restricted. It is not exhaustive and does not limit the disclosure to the precise form disclosed. Modifications and variations are possible in light of the above teachings or may be acquired from practicing of the disclosure, without departing from the breadth or scope. Reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. The scope of the invention is indicated by the appended claims rather than the foregoing description and all changes that come within the meaning and range and equivalence thereof are intended to be embraced therein.

What is claimed is:

1. A windshield assembly for a marine vessel, comprising:

a plurality of first extrusions arranged vertically;

a plurality of second extrusions, wherein each second extrusion is a crossbar arranged between a pair of first extrusions; and an opening formed between each pair of second extrusions connected between a common pair of first extrusions, wherein each opening includes a plurality of receivers formed for framing a panel, the plurality of receivers formed on a surface of each first extrusion and each second extrusion of a respective opening, and wherein a front opening includes an upper second extrusion and movable front panel, the movable front panel being connected to rotate about the upper second extrusion for venting.

2. The windshield assembly according to claim 1, wherein first receivers of each first extrusion of a respective opening are shaped to mate with ends of each second extrusion of the respective opening.

3. The windshield assembly according to claim 1, wherein each panel is bonded to the receivers of each respective opening.

4. The windshield assembly according to claim 1, wherein the movable front panel is a movable upper panel, the front opening including the movable upper panel and a fixed lower panel, wherein the fixed lower panel has a greater height than the lower front panel.

5. The windshield assembly according to claim 4, comprising:

a seal attached to an upper edge of the fixed lower panel.

6. The windshield assembly according to claim 5, wherein the second extrusions include a plurality of upper second extrusions and a plurality of lower second extrusions, the assembly comprising:

a top panel mounted to top surfaces of the first extrusions and top surfaces of the upper second extrusions; and an actuator assembly mounted to an inner surface of the top panel.

7. The windshield assembly according to claim 6, wherein the actuator assembly includes an arm having a distal end mounted to an inner surface of the movable upper panel of the front opening.

8. The windshield assembly according to claim 7, wherein:

the upper second extrusions include a forward upper second extrusion and an aft upper second extrusion, an upper edge of the movable upper panel is mounted to the forward upper second extrusion via a hinge and a lower edge of the movable upper panel is movable with respect to the seal attached to the upper edge of the fixed lower panel, and the actuator assembly is configured to drive the arm such that the movable upper front panel is movable to an open position and a closed position with respect to a surface of the seal.

9. The windshield assembly according to claim 8, wherein the arm is configured to rotate the movable upper panel about the hinge in a clockwise direction to the open position.

10. A windshield enclosure for a center console boat, comprising:

a frame including a plurality of first members and a plurality of second members, each of the first members and second members having extruded profiles forming receiver planes, each second member being arranged horizontally between a pair of vertical first members;

a plurality of apertures formed in the frame wherein upper and lower second members are arranged between a common pair of vertical first members; and at least one panel arranged in each aperture, each at least one panel being framed by a receiver plane of respective first and second members bordering the aperture, wherein a front aperture of the plurality of apertures includes a movable upper panel and a fixed lower panel, a lower edge of the movable upper panel is rotatable to an open and closed position with respect to a seal connected to an upper edge of the fixed lower panel.

11. The windshield enclosure according to claim 10, comprising:

a hard top mounted to top surfaces of the first members and the upper second members; and a hinge connected to an inner surface of the hard top, wherein an upper edge of the movable upper panel is connected to the hinge.

12. The windshield enclosure according to claim 11, comprising:

an actuator assembly having an arm connected to an inner surface of the movable upper panel, the actuator assembly configured to drive the arm and rotate the upper panel about the hinge and into and out of contact with the seal.

13. The windshield enclosure according to claim 12, wherein the movable upper panel is an inward opening air ram or vent.

14. The windshield enclosure according to claim 10, wherein the plurality of first members includes at least one internal cavity or tube arranged as a conduit for wiring or connections.

15. The windshield enclosure according to claim 10, wherein the at least one internal cavity is formed as an asymmetrical internal bulkhead structure.

16. A center console for marine vessel, comprising:

a frame including:

a plurality of openings for receiving a panel, each opening being bordered by a pair of vertical first members and a pair of horizontal second members, each first and second member having a flange on an inner edge for receiving the panel;

a hard top mounted to the top of the frame; and a front opening of the plurality of openings bordering a movable upper panel and a fixed lower panel, wherein the movable upper panel is mounted to a hinge on an inner surface of the hard top and the movable upper panel is rotatable in a clockwise direction about the hinge to direct air flow through an inside of the frame.

17. The center console according to claim 16, comprising: an actuator mounted to an inner surface of the hard top of the frame, the actuator having an arm attached to an inner surface of the movable upper panel for rotating the movable upper panel in the clockwise direction about the hinge.

18. The center console according to claim 16, comprising: a seal attached to an upper edge of the fixed lower panel, the movable upper panel being configured to prevent air flowing through an inside of the frame when a lower edge of the movable upper panel is in contact with the seal.

19. The center console according to claim 16, wherein each first member includes at least one internal cavity or tube arranged as a conduit for wiring or connections.

20. The center console according to claim 16, wherein each first member has a first flange for receiving a side panel of the plurality of panels and a second flange for receiving a front panel of the plurality of panels.

* * * * *